US009290897B2

(12) United States Patent
Schisel et al.

(10) Patent No.: US 9,290,897 B2
(45) Date of Patent: Mar. 22, 2016

(54) SNOW THROWER CHUTE ROTATION MECHANISM

(71) Applicant: Ariens Company, Brillion, WI (US)

(72) Inventors: Travis Schisel, Cato, WI (US); Scot Koehler, Appleton, WI (US); Craig A. Key, Green Bay, WI (US); Scott M. Lyman, De Pere, WI (US)

(73) Assignee: Ariens Company, Brillion, WI (US)

( * ) Notice: Subject to any disclaimer, the term of this patent is extended or adjusted under 35 U.S.C. 154(b) by 21 days.

(21) Appl. No.: 14/171,244

(22) Filed: Feb. 3, 2014

(65) Prior Publication Data

US 2015/0218764 A1 Aug. 6, 2015

(51) Int. Cl.
*E01H 5/04* (2006.01)
*E01H 5/09* (2006.01)

(52) U.S. Cl.
CPC ..... *E01H 5/045* (2013.01); *E01H 5/098* (2013.01)

(58) Field of Classification Search
CPC ..... E01H 5/045; E01H 5/098
See application file for complete search history.

(56) References Cited

U.S. PATENT DOCUMENTS

| | | | |
|---|---|---|---|
| 3,251,631 | A | 5/1966 | Hennen |
| 3,509,977 | A | 5/1970 | Bacon |
| 3,742,626 | A | 7/1973 | Ellis |
| 3,760,517 | A | 9/1973 | Blaauw |
| 3,879,866 | A | 4/1975 | Gunderson |
| 4,068,397 | A | 1/1978 | Bacon |
| 4,072,359 | A | 2/1978 | Lillkvist |
| 4,150,501 | A | 4/1979 | Hayashi |
| 4,205,468 | A | 6/1980 | Greider |
| 4,409,748 | A | 10/1983 | Westimayer |
| 4,541,187 | A | 9/1985 | Phelps |
| 4,862,607 | A | 9/1989 | Wacker |
| 5,177,888 | A | 1/1993 | Thorud et al. |
| 5,735,064 | A | 4/1998 | Holl |
| 6,318,003 | B1 | 11/2001 | Heismann |
| 6,381,881 | B1 | 5/2002 | Heismann |
| 6,578,292 | B2 | 6/2003 | Dowe et al. |
| 6,952,893 | B1 | 10/2005 | Sanderson |
| 7,032,333 | B2 | 4/2006 | Friberg et al. |
| 7,093,380 | B2 | 8/2006 | Hubscher et al. |
| 7,165,345 | B2 | 1/2007 | Beaudoin |

(Continued)

FOREIGN PATENT DOCUMENTS

| | | |
|---|---|---|
| CN | 202416238 | 9/2012 |
| GB | 2388142 | 11/2003 |

(Continued)

*Primary Examiner* — Matthew D Troutman
(74) *Attorney, Agent, or Firm* — Michael Best & Friedrich LLP

(57) ABSTRACT

A chute rotation mechanism for a snow thrower having a frame and a chute rotatably mounted to the frame includes a ring gear configured to be mounted to the chute, a drive gear engaging the ring gear, and a handle assembly configured to pivot relative to the frame. The chute rotation mechanism also includes a first cable extending between the drive gear and the handle assembly. The handle assembly is pivotable in a first direction to tension the first cable and rotate the drive gear, thereby rotating the ring gear in a corresponding first direction. The chute rotation mechanism further includes a second cable extending between the drive gear and the handle assembly. The handle assembly is pivotable in a second direction to tension the second cable and rotate the drive gear, thereby rotating the ring gear in a corresponding second direction.

23 Claims, 6 Drawing Sheets

(56) References Cited

U.S. PATENT DOCUMENTS

| | | | | |
|---|---|---|---|---|
| 7,194,827 | B2 | 3/2007 | Mercer et al. | |
| 7,347,013 | B2 | 3/2008 | Deschler et al. | |
| 7,472,500 | B2 | 1/2009 | White, III | |
| 7,493,711 | B2 | 2/2009 | Gautreau et al. | |
| 7,540,102 | B2 | 6/2009 | Olmr et al. | |
| 7,624,521 | B2 | 12/2009 | White, III et al. | |
| 7,703,223 | B2 | 4/2010 | Walker et al. | |
| 7,735,246 | B2 | 6/2010 | Kaskawitz | |
| 8,016,098 | B2 | 9/2011 | Saiia | |
| 2002/0189137 | A1 | 12/2002 | Cox et al. | |
| 2003/0226738 | A1 | 12/2003 | Eakins et al. | |
| 2008/0163520 | A1* | 7/2008 | White et al. | 37/260 |
| 2008/0209771 | A1 | 9/2008 | Jerger et al. | |
| 2009/0205226 | A1 | 8/2009 | Olmr et al. | |
| 2012/0198732 | A1 | 8/2012 | Ferrell et al. | |
| 2014/0102241 | A1 | 4/2014 | Rao et al. | |
| 2014/0157633 | A1* | 6/2014 | Hansen et al. | 37/260 |

FOREIGN PATENT DOCUMENTS

| | | |
|---|---|---|
| WO | 2012094320 | 7/2012 |
| WO | 2012177234 | 12/2012 |

* cited by examiner

SNOW THROWER CHUTE ROTATION MECHANISM

FIELD OF THE INVENTION

The present invention relates to snow throwers or snow blowers and, more particularly, to chute rotation mechanisms for snow throwers.

SUMMARY

In one embodiment, the invention provides a chute rotation mechanism for a snow thrower. The snow thrower includes a frame and a chute rotatably mounted to the frame. The chute rotation mechanism includes a ring gear configured to be mounted to the chute, a drive gear engaging the ring gear, and a handle assembly configured to pivot relative to the frame. The chute rotation mechanism also includes a first cable extending between the drive gear and the handle assembly. The handle assembly is pivotable in a first direction to tension the first cable and rotate the drive gear, thereby rotating the ring gear in a corresponding first direction. The chute rotation mechanism further includes a second cable extending between the drive gear and the handle assembly. The handle assembly is pivotable in a second direction to tension the second cable and rotate the drive gear, thereby rotating the ring gear in a corresponding second direction.

In another embodiment, the invention provides a snow thrower including a frame having an auger housing, a plurality of wheels coupled to the frame, a prime mover supported by the frame, an auger positioned within the auger housing and coupled to the prime mover to be driven by the prime mover, a chute rotatably mounted to the frame to direct material away from the frame, and a chute rotation mechanism supported by the frame and operable to rotate the chute relative to the frame. The chute rotation mechanism includes a ring gear fixed to the chute, a drive gear engaging the ring gear, and a handle assembly pivotable relative to the frame. The chute rotation mechanism also includes a first cable extending between the drive gear and the handle assembly. The handle assembly is pivotable in a first direction to tension the first cable and rotate the drive gear, thereby rotating the ring gear and the chute in a corresponding first direction. The chute rotation mechanism further includes a second cable extending between the drive gear and the handle assembly. The handle assembly is pivotable in a second direction to tension the second cable and rotate the drive gear, thereby rotating the ring gear and the chute in a corresponding second direction.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1:
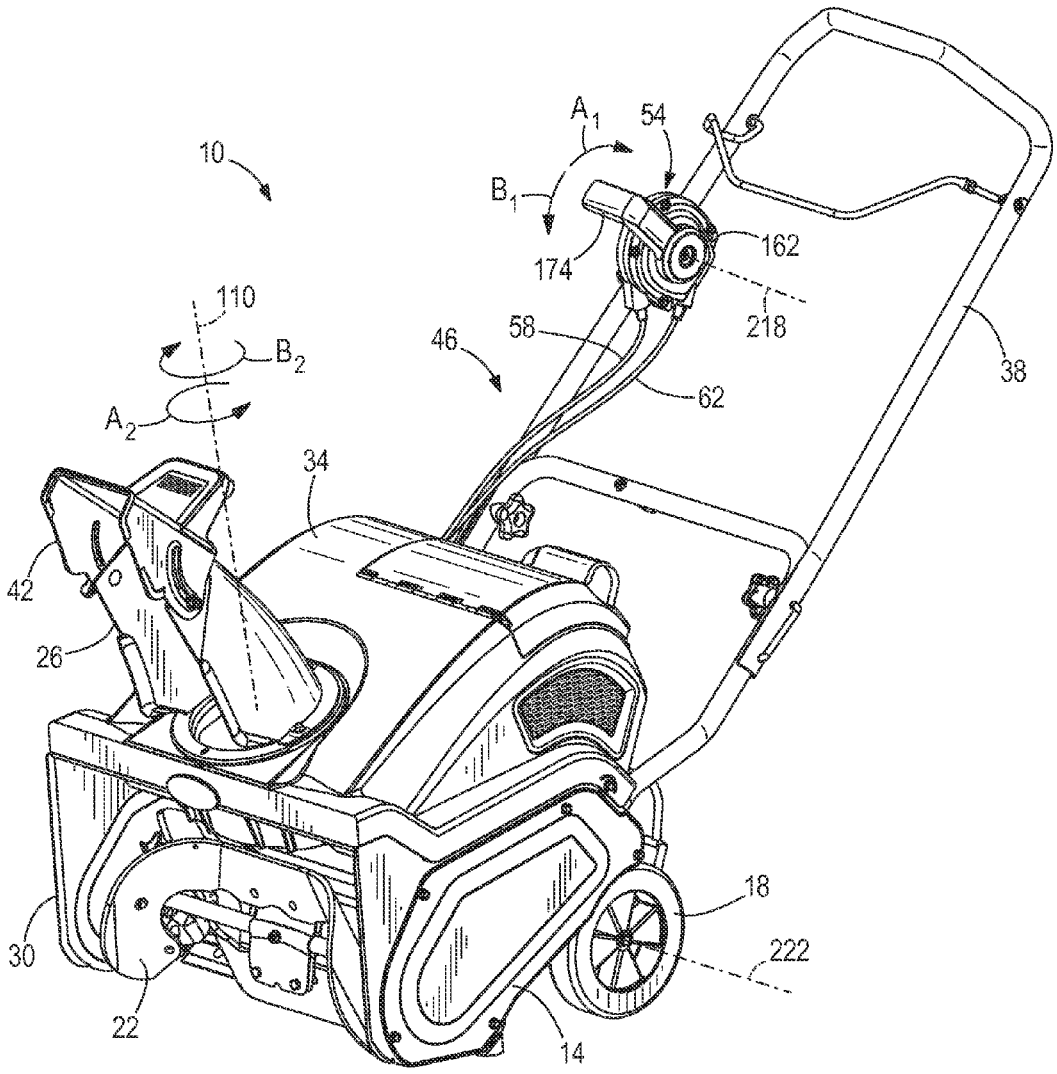
FIG. 1 is a front perspective view of a snow thrower including a chute rotation mechanism.
Figure 2:
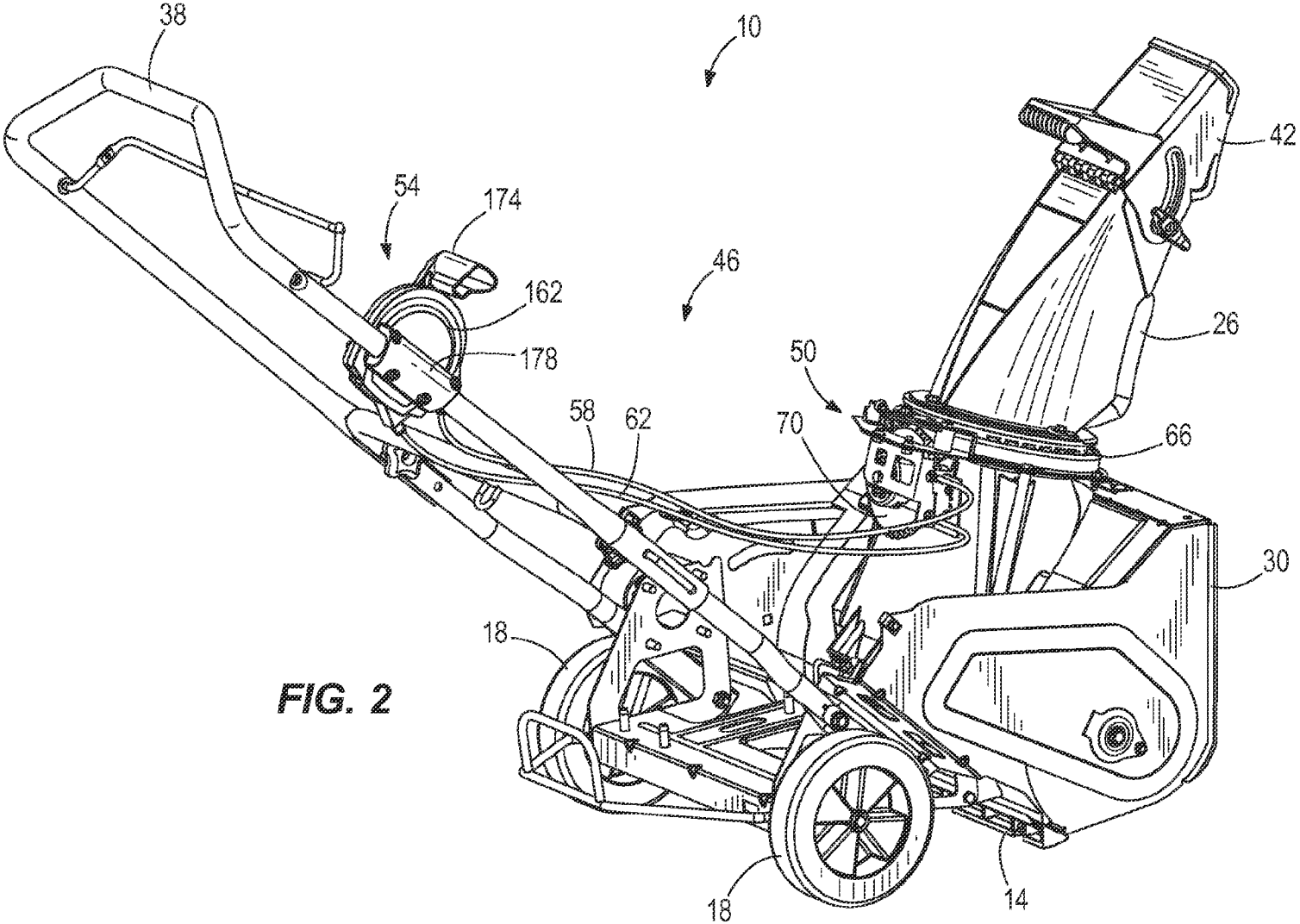
FIG. 2 is a rear perspective view of the snow thrower with a housing portion removed to facilitate illustration of the chute rotation mechanism.

FIGS. 1 and 2 illustrate a snow thrower 10, or snow blower, including a frame 14, a plurality of wheels 18, a prime mover, an auger 22, and a chute 26. The frame 14 includes an auger housing 30, a motor housing 34, and an operator control assembly 38. The operator control assembly 38 extends from the frame 14 in a direction opposite the auger housing 30 and includes controls to operate the snow thrower 10. The operator control assembly 38 is also configured to be grasped by an operator to move and maneuver the snow thrower 10 along a surface. The wheels 18 are rotatably coupled to the frame 14 to facilitate moving the snow thrower 10 along the surface.

The prime mover is supported by the frame 14 and positioned within the motor housing 34. The prime mover includes a two-stroke or four-stroke internal combustion engine that is coupled to the auger 22 to drive the auger 22. In other embodiments, the prime mover may include a battery-powered electric motor that is coupled to the auger 22 to drive the auger 22. In some embodiments, the prime mover (whether an internal combustion engine or an electric motor) may also be coupled to the wheels 18 to drive the wheels 18.

The auger 22 is positioned within the auger housing 30 and coupled to the prime mover. The auger 22 is operable to be driven (e.g., rotated) by the prime mover to draw snow into the auger housing 30 and push the snow through the chute 26. In the illustrated embodiment, the snow thrower 10 is a single-stage snow thrower such that the auger 22 both draws snow in and pushes snow out of the snow thrower 10. In other embodiments, the snow thrower 10 may be a two-stage snow thrower including a secondary impeller or fan adjacent the chute 26 that is driven by the prime mover and that throws snow out through the chute 26.

The chute 26 is mounted to the frame 14 to direct snow and other material away from the frame 14. The illustrated chute 26 is rotatably mounted above the auger housing 30 of the frame 14. In other embodiments, the chute 26 may be located elsewhere on the frame 14. The chute 26 is rotatable relative to the frame 14 to discharge snow in different directions, as desired by an operator of the snow thrower 10. The chute 26 also includes a deflector 42 this is manually pivotable to change the arc at which snow is discharged from the chute 26.

The snow thrower 10 also includes a chute rotation mechanism 46. The chute rotation mechanism 46 is operable by an operator of the snow thrower 10 to rotate the chute 26 relative to the frame 10. In the illustrated embodiment, the chute rotation mechanism 46 includes a drive assembly 50 (FIG. 2) mounted to the frame 14 adjacent the chute 26 and a handle assembly 54 mounted to the operator control assembly 38 of the frame 14.

Figure 3:
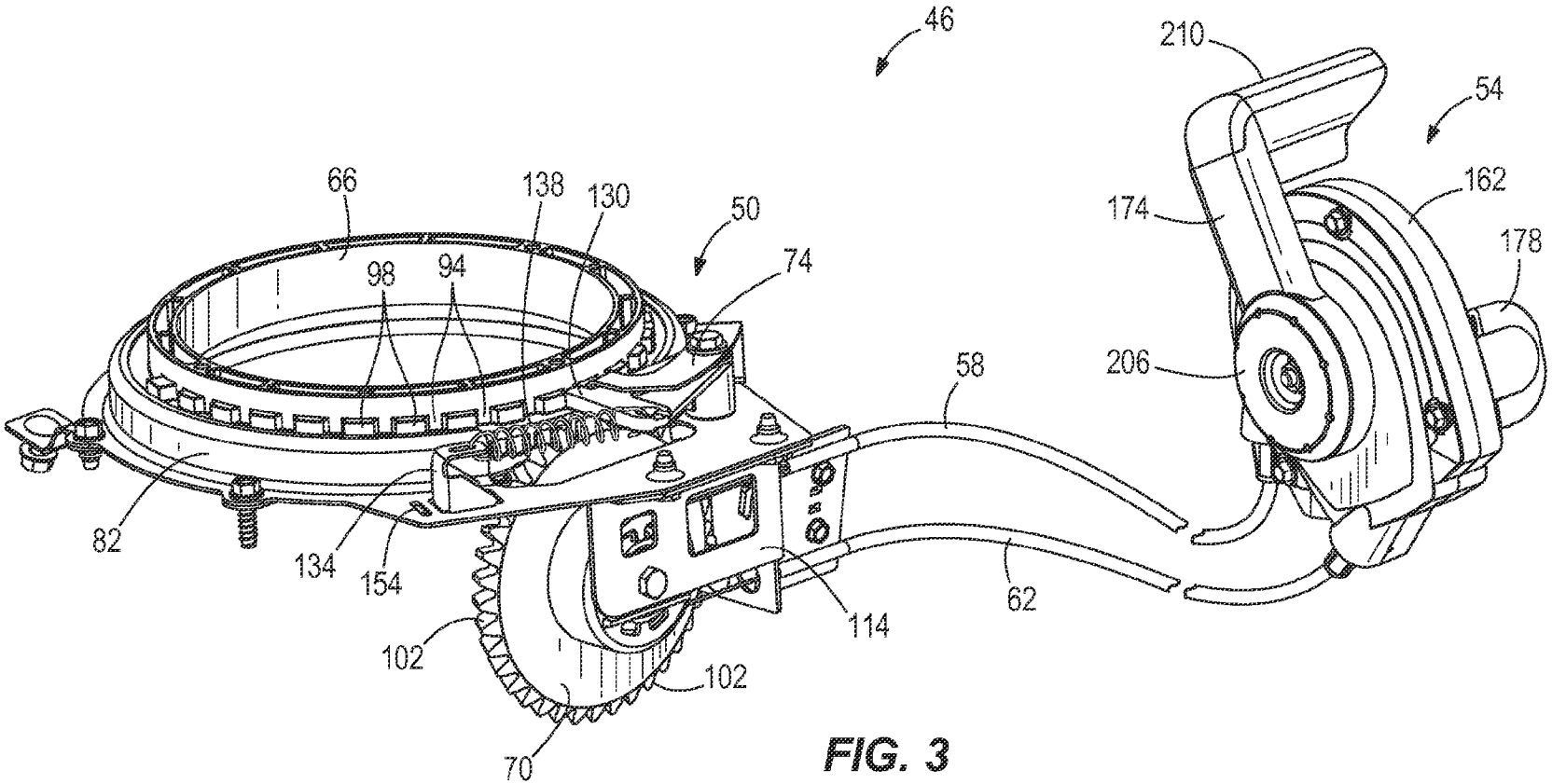
FIG. 3 is a perspective view of the chute rotation mechanism, the chute rotation mechanism including a drive assembly and a handle assembly.

FIG. 3 illustrates the chute rotation mechanism 46 in more detail. The illustrated chute rotation mechanism 46 includes two cables or wires 58, 62 extending between the drive assembly 50 and the handle assembly 54. The cables 58, 62 are alternately tensionable by pivoting the handle assembly 54 to rotate the chute 26 in opposing direction. For example, pivoting the handle assembly 54 in a first direction to tension or pull the first cable 58 rotates the chute 26 in a corresponding first direction, and pivoting the handle assembly 54 in a second direction to tension or pull the second cable 62 rotates the chute 26 in a corresponding second direction.

Figure 4:
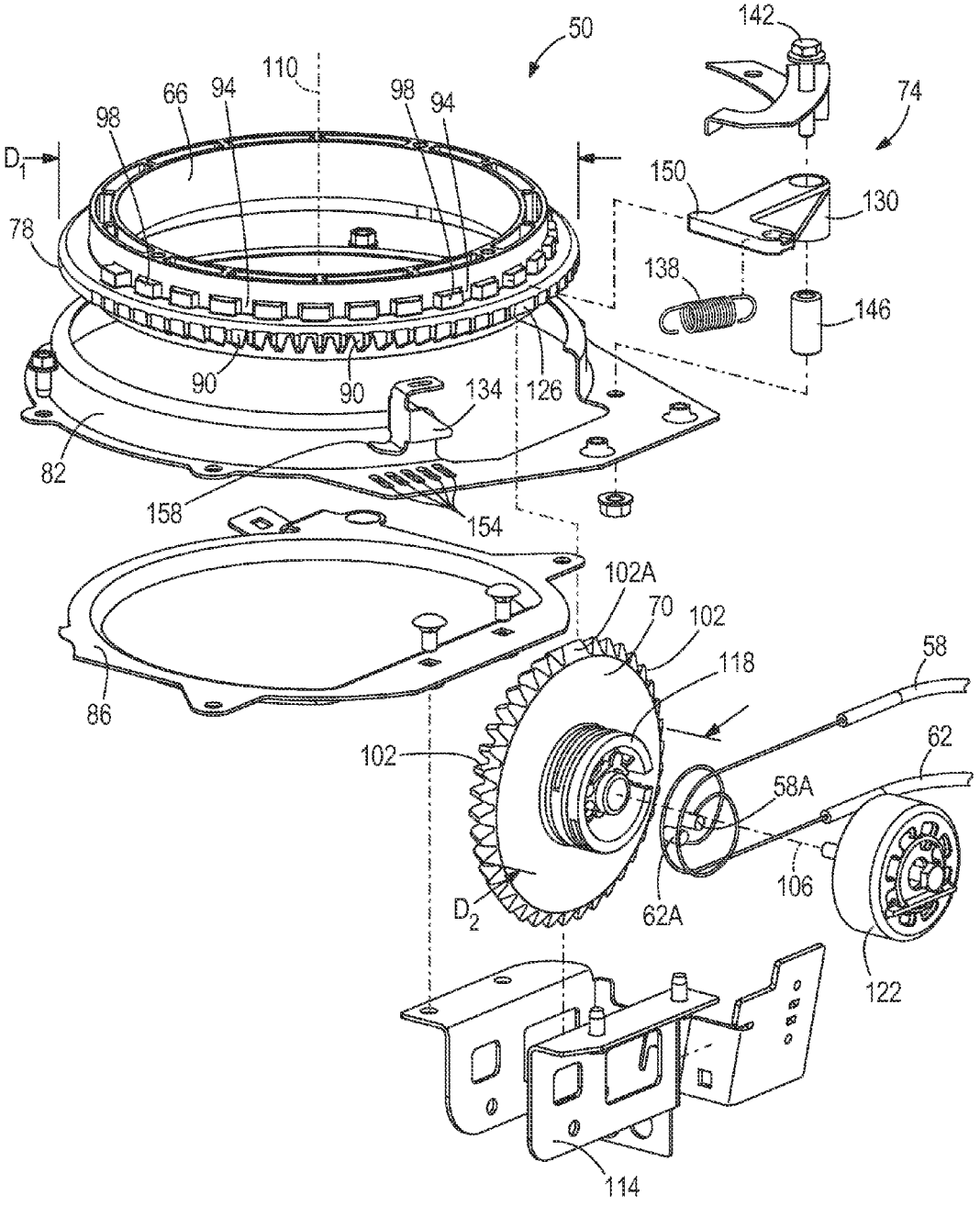
FIG. 4 is an exploded perspective view of the drive assembly of the chute rotation mechanism.

As shown in FIGS. 3 and 4, the drive assembly 50 includes a ring gear 66, a drive gear 70, and a detent mechanism 74. The ring gear 66 is configured to be mounted to the chute 26 (FIGS. 1 and 2) such that the ring gear 66 is fixed to the chute 26. In some embodiments, the ring gear 66 may be secured to the chute 26 by, for example, threaded fasteners or welding. In other embodiments, the ring gear 66 may be integrally formed as a single piece with the chute 26. The illustrated ring gear 66 includes a radially-extending flange 78 that is captured between an upper mounting plate 82 and a lower mounting plate 86 to couple the ring gear 66 to the frame 14 of the snow thrower 10. The ring gear 66 also includes a series of gear teeth 90 formed on the flange 78. The teeth 90 are configured to be engaged by the drive gear 70. The ring gear 66 further includes a series of detents 94 defined by a series of projections 98. The detents 94 are located generally above the flange 78 and are configured to be engaged by the detent mechanism 74.

The drive gear 70 engages the ring gear 66 to drive (e.g., rotate) the ring gear 66. In the illustrated embodiment, the drive gear 70 is a bevel gear and includes a series of teeth 102 that intermesh with the series of teeth 90 of the ring gear 66. As such, the drive gear 70 is rotatable about a drive axis 106 that is generally perpendicular (within 15 degrees) to a chute rotation axis 110 of the ring gear 66 (i.e., the axis 110 about which the chute 26 (FIG. 1) also rotates). In other embodiments, the drive gear 70 may be a different type of gear suitable for intermeshing with and driving the ring gear 66. The illustrated drive gear 70 is partially received within a mounting bracket 114 to couple the drive gear 70 to the frame 14 of the snow thrower 10. The drive gear 70 also includes a hub or spool 118 that receives ends 58A, 62A of the first and second cables 58, 62 to secure the cables 58, 62 to the drive gear 70. A spool shroud 122 is coupled to the hub 118 to cover the ends 58A, 62A of the cables 58A, 62A and lock the ends 58A, 62A in place. In the illustrated embodiment, the spool shroud 122 is threadably coupled to the hub 118, but may alternatively be coupled to the hub 118 using other suitable coupling means.

Figure 7:
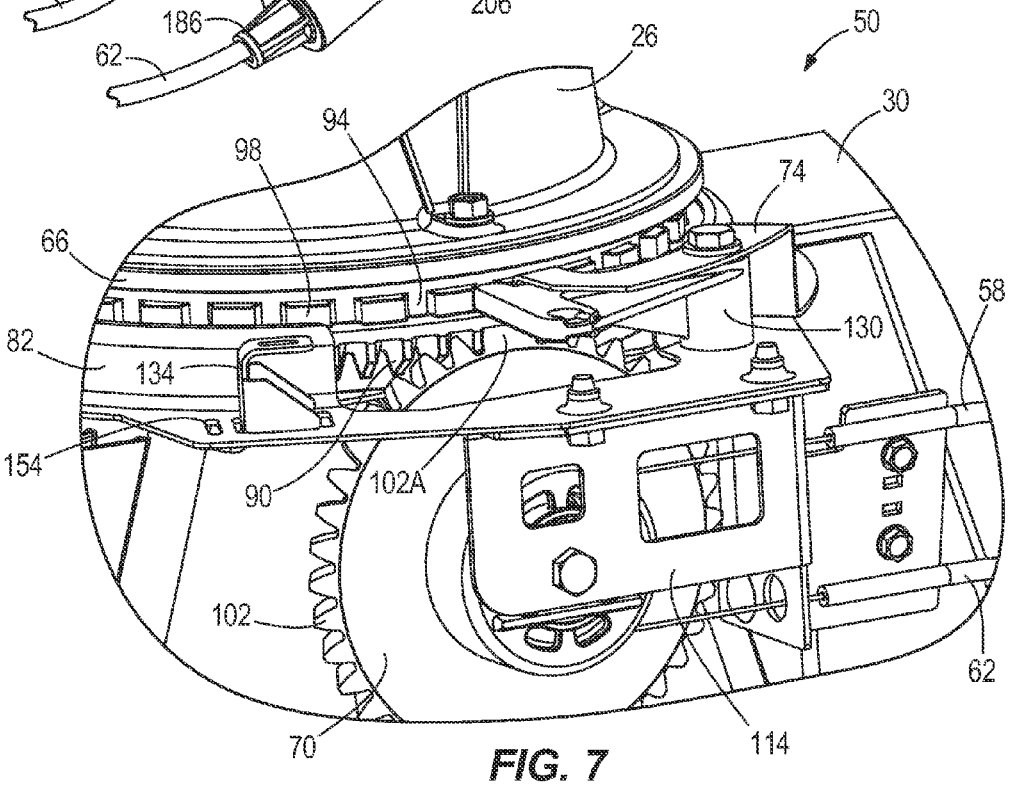
FIG. 7 is an enlarged view of the drive assembly of the chute rotation mechanism mounted to a portion of the snow thrower.

In the illustrated embodiment, the series of teeth 102 on the drive gear 70 includes one relatively large tooth 102A (i.e., one tooth that is larger than the rest of the teeth 102). The relatively large tooth 102A is received in a relatively large recess 126 between adjacent teeth of the series of teeth 90 on the ring gear 66 (i.e., a recess that is larger than the other recesses between the teeth 90), as shown in FIG. 7. The relatively large tooth 102A helps properly align the drive gear 70 with the ring gear 66 when, for example, initially installing the chute rotation mechanism 46. That is, since the relatively large tooth 102A of the drive gear 70 only fits within the relatively large recess 126 of the ring gear 66, the drive assembly 50 can only be assembled in one orientation that allows the drive gear 70 to properly intermesh with the ring gear 66.

Referring back to FIGS. 3 and 4, the detent mechanism 74 is coupled to and supported by the upper mounting plate 82 of the frame 14. The detent mechanism 74 engages the ring gear 66 to releasably hold the chute 26 in a plurality of discrete rotational positions. The illustrated detent mechanism 74 includes a pawl 130, a bracket 134, and a biasing member 138. The pawl 130 is pivotally coupled to the upper mounting plate 82 by a threaded fastener 142. A bushing 146 is positioned within the pawl 130 to facilitate movement of the pawl 130 relative to the fastener 142. The pawl 130 includes a tooth 150 that fits within the detents 94 of the ring gear 66, thereby inhibiting the chute 26 from shifting during operation of the snow thrower 10. The bracket 134 is mounted to the upper mounting plate 82 and spaced apart from the pawl 130. The biasing member 138 is coupled to and extends between the pawl 130 and the bracket 134. The biasing member 138 biases the pawl 130 into engagement with the ring gear 66. In the illustrated embodiment, the biasing member 138 is a coil spring. In other embodiments, other suitable biasing members may also or alternatively be employed.

During operation of the chute rotation mechanism 46, the detent mechanism 74 may be manually overcome by pivoting the handle assembly 54. That is, pivoting the handle assembly 54 with sufficient force to tension either the first cable 58 or the second cable 62 causes the projections 98 on the ring gear 66 to force the pawl 130 out of the corresponding detent 94, without separate actuation of the detent mechanism 74. When the pawl 130 clears each projection 98, the pawl 130 is automatically biased back toward the ring gear 66 and into engagement with the next detent 94 by the biasing member 138. In other embodiments, the detent mechanism 74 may be manually released by a separate actuator or an actuator carried on the handle assembly 54.

As shown in FIG. 4, the illustrated upper mounting plate 82 defines a plurality of slots 154. The bracket 134 of the detent mechanism 74 includes a foot 158 that is alternately receivable in each of the slots 154. As such, the bracket 134 is mountable in different locations on the upper mounting plate 82 relative to the pawl 130 to adjust a biasing force of the biasing member 138 on the pawl 130. For example, by positioning the bracket 134 in the slot 154 closest to the pawl 130, the biasing member 138 exerts a relatively small force on the pawl 130 that may be more easily overcome when pivoting the handle assembly 54. In contrast, by positioning the bracket 134 in the slot 154 furthest from the pawl 130, the biasing member 138 exerts a relatively large force on the pawl 130 that is harder to overcome when pivoting the handle assembly 54. The force required to overcome the detent mechanism 74 and rotate the chute 26 is, thereby, adjustable for different operators or as the biasing member 138 loses its spring force over time.

Figure 5:
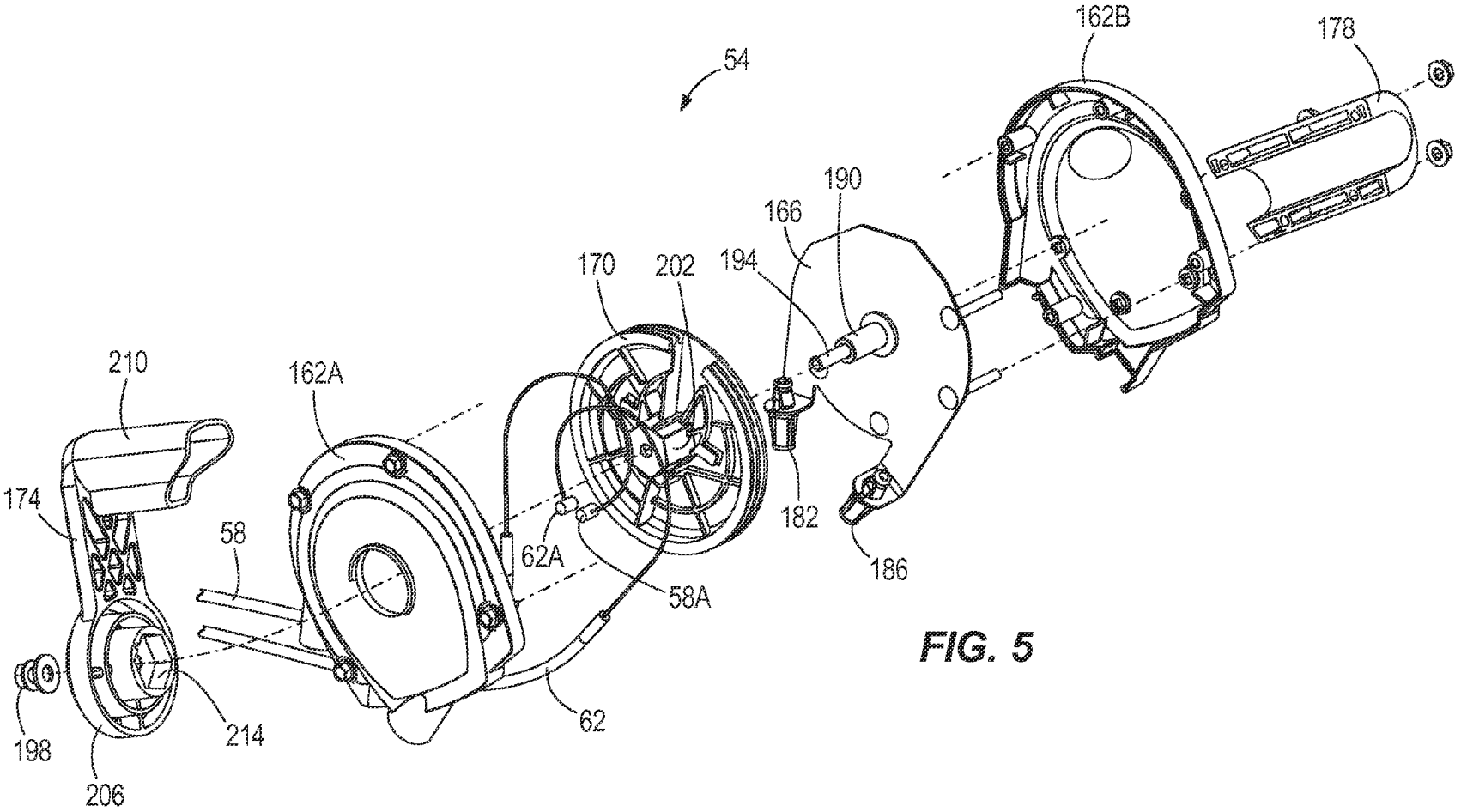
FIG. 5 is an exploded perspective view of the handle assembly of the chute rotation mechanism.
Figure 6:
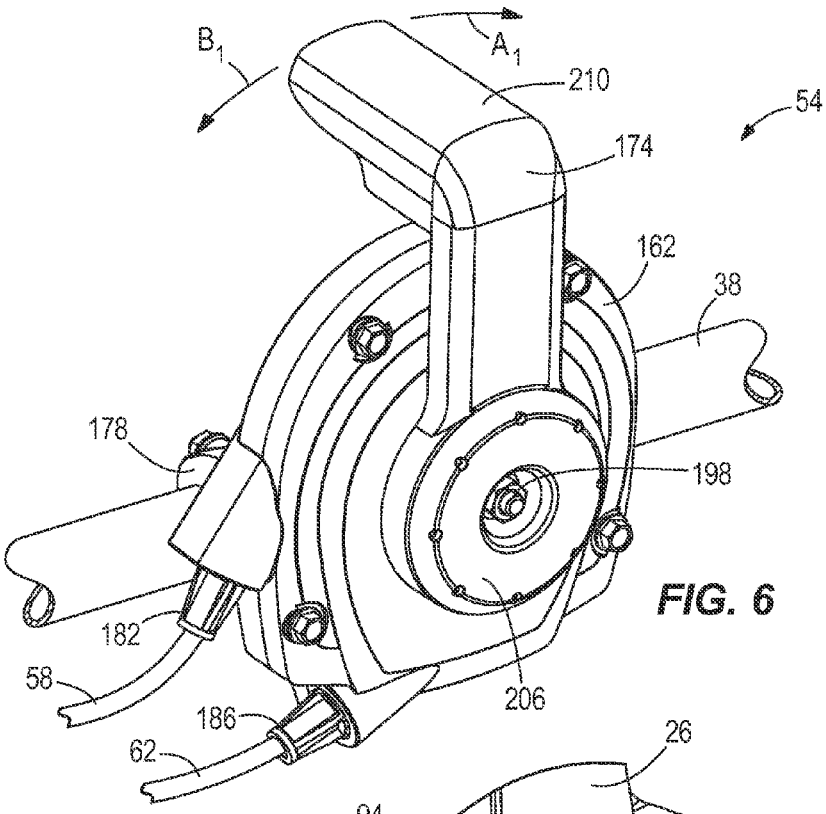
FIG. 6 is an enlarged view of the handle assembly of the chute rotation mechanism mounted to a portion of the snow thrower.

As shown in FIGS. 3 and 5, the handle assembly 54 includes a housing 162, a frame 166, a pulley 170, and a handle 174. The illustrated housing 162 includes a first housing portion 162A and a second housing portion 162B that are coupled together (e.g., by threaded fasteners) to surround the frame 166 and the pulley 170. The housing 162 is mounted to the operator control assembly 38 (FIGS. 1 and 2) of the frame 14 by a U-shaped bracket 178. The bracket 178 surrounds a portion of the operator control assembly 38 to secure the housing 162 in place, as shown in FIG. 6.

Referring back to FIG. 5, the frame 166 is positioned within the housing 162 to support the pulley 170. The illustrated frame 166 includes two cable guides 182, 186 and a central mounting post 190. The cable guides 182, 186 extend partially out of the housing 162 and help guide the first and second cables 58, 62 into the housing 162. The mounting post 190 extends axially from the frame 166 and includes a threaded end portion 194. The threaded end portion 194 threadably engages a nut 198 to secure the pulley 170 and the handle 174 to the frame 166.

The pulley 170 is positioned within the housing 162 and supported on the frame 166 by the mounting post 190. The pulley 170 includes a central hub 202 that receives the mounting post 190 such that the pulley 170 is rotatable relative to the frame 166 and the housing 162. In the illustrated embodiment, the central hub 202 of the pulley 170 has a hexagonal cross-sectional shape. In other embodiments, the central hub 202 may have other non-circular cross-sectional shapes (e.g., D-shaped, square, etc.). The pulley 170 also receives ends 58B, 62B of the first and second cables 58, 62 to secure the cables 58, 62 to the pulley 170.

The handle 174 is coupled to the pulley 170 and extends from the housing 162. The handle 162 includes a mounting portion 206 and a grip portion 210. The mounting portion 206 defines a hexagonal recess 214 that receives the central hub 202 of the pulley 170 so that the handle 174 and the pulley 170 pivot together relative to the housing 162. The grip portion 210 is configured to be grasped by an operator. The grip portion 210 provides a lever arm for the operator to pivot the handle 174 and the pulley 170 and, thereby, alternately tension the first and second cables 58, 62.

When the handle 174 and the pulley 170 are assembled onto the mounting post 190, the handle 174 and the pulley 170 are secured in place by the threaded end portion 194 and the nut 198. The nut 198 clamps the pulley 174 between the mounting portion 206 of the handle 174 and the frame 166. As such, the nut 198 may be adjusted (e.g., tightened or loosened) to change the frictional force between the pulley 174 and the frame 166. Increasing the frictional force will require an operator to exert more force to pivot the handle 174 and the pulley 170 relative to the housing 162 and the frame 166, thereby ultimately requiring more force to rotate the chute 26. Decreasing the frictional force requires an operator to exert less force to pivot the handle 174 and the pulley 170 relative to the housing 162 and the frame 166, thereby ultimately requiring less force to rotate the chute 26. In other embodiments, other types of threaded fasteners may be used to adjust the frictional force between the pulley 170 and the frame 166.

As shown in FIG. 1, the illustrated handle 174 pivots about an axis 218 that is generally parallel to an axis 222 about which the wheels 18 rotate (i.e., an axis that is generally parallel to the ground). In addition, the mounting portion 206 of the handle 174 extends from a side face of the housing 162 generally along the axis 218. Such an arrangement eliminates exposed gaps between the handle 174 and the housing 162 (compared to a handle assembly where the handle extends out of a slot in an upper surface of the housing) to reduce the possibility of snow or water entering the housing 162.

In operation, the handle assembly 54 is pivotable relative to the frame 14 to alternately tension the first and second cables 58, 62 and rotate the chute 26. More specifically, as shown in FIG. 6, the handle 174 is pivotable through an arc in a first direction $A_1$ to pivot the pulley 170 relative to the frame 166 and tension the first cable 58. Tensioning the first cable 58 pulls the drive gear 70 (FIG. 7) to rotate the drive gear 70 relative to the ring gear 66. The drive gear 70, thereby, rotates the ring gear 66 in a corresponding first direction $A_2$ (FIG. 1) such that the chute 26 also rotates in the corresponding first direction $A_2$.

The handle 174 is also pivotable through an arc in a second direction $B_1$ (FIG. 6) that is substantially opposite the first direction $A_1$ to pivot the pulley 170 relative to the frame 166 and tension the second cable 62. Tensioning the second cable 62 pulls the drive gear 70 (FIG. 7) to rotate the drive gear 70 relative to the ring gear 66. The drive gear 70, thereby, rotates the ring gear 66 in a corresponding second direction $B_2$ (FIG. 1) such that the chute 26 also rotates in the corresponding second direction $B_2$.

Referring to FIG. 4, the illustrated ring gear 66 has a first diameter $D_1$, and the illustrated drive gear 70 has a second diameter $D_2$. A ratio of the second diameter $D_2$ to the first diameter $D_1$ is less than 1.0 such that the drive gear 70 is smaller than the ring gear 66. As such, when the drive gear 70 is rotated by pivoting the handle assembly 54, the ring gear 66 moves (e.g., rotates) a greater distance than the drive gear 70. The illustrated drive assembly 50, thereby, provides a mechanical advantage for an operator to rotate the chute 26 using the remote handle assembly 54. For example, in the illustrated embodiment, movement of the handle assembly 54 through an arc of about 180 degrees will also rotate the drive gear 70 about 180 degrees, but will rotate the ring gear 66 (and, thereby, the chute 26) about 220 degrees. A ratio of movement of the chute 26 to movement of the handle assembly 54 is, therefore, at least about 1.2. In other embodiments, the relative sizes of the ring gear 66 and the drive gear 70 may be different to adjust the ratio between chute movement and handle movement.

The illustrated chute rotation mechanism 46 includes relatively few components that are easy to assemble and intuitive to operate to rotate a chute on a snow thrower. In addition, the chute rotation mechanism 46 provides multiple points of adjustment (e.g., at the handle assembly 54 and at the detent mechanism 74) to adjust a force required to operate the mechanism 46 for different operators. Furthermore, the chute rotation mechanism 46 can be installed onto an existing snow thrower as an aftermarket kit (with the drive gear 70, the handle assembly 54, and the cables 58, 62) without requiring many structural modifications to the snow thrower.

Various features and advantages of the invention are set forth in the following claims.

What is claimed is:

1. A chute rotation mechanism for a snow thrower, the snow thrower including a frame and a chute rotatably mounted to the frame, the chute rotation mechanism comprising:

a ring gear configured to be mounted to the chute;

a drive gear engaging the ring gear;

a handle assembly configured to pivot relative to the frame;

a first cable extending between the drive gear and the handle assembly, wherein the handle assembly is pivotable in a first direction to tension the first cable and rotate the drive gear, thereby rotating the ring gear in a corresponding first direction; and a second cable extending between the drive gear and the handle assembly, wherein the handle assembly is pivotable in a second direction to tension the second cable and rotate the drive gear, thereby rotating the ring gear in a corresponding second direction, wherein the ring gear rotates about a chute rotation axis, and wherein the drive gear rotates about a drive axis that is generally perpendicular to the chute rotation axis.

2. The chute rotation mechanism of claim 1, wherein the drive gear is a bevel gear.

3. The chute rotation mechanism of claim 1, wherein the ring gear has a first diameter and the drive gear has a second diameter, and wherein a ratio of the second diameter to the first diameter is less than 1.0.

4. The chute rotation mechanism of claim 3, wherein movement of the handle assembly through an arc of about 180 degrees rotates the ring gear about 220 degrees.

5. The chute rotation mechanism of claim 1, wherein the ring gear includes a first series of teeth and the drive gear includes a second series of teeth, and wherein the second series of teeth includes a relatively large tooth that is receivable in a relatively large recess between adjacent teeth of the first series of teeth.

6. The chute rotation mechanism of claim 1, further comprising a detent mechanism configured to releasably hold the chute in a plurality of discrete rotational positions.

7. The chute rotation mechanism of claim 1, wherein the detent mechanism includes a pawl configured to be pivotally coupled to the frame, the pawl being engageable with the ring gear to hold the ring gear against rotation and being pivotable away from the ring gear to allow rotation of the ring gear, and a biasing member coupled to the pawl to bias the pawl into engagement with the chute.

8. The chute rotation mechanism of claim 1, wherein the handle assembly includes a housing, a pulley positioned within the housing, and a handle coupled to the pulley and extending from the housing, and wherein the pulley and the handle are configured to be pivoted relative to the housing.

9. The chute rotation mechanism of claim 8, wherein the handle is coupled to the pulley by a threaded fastener, and wherein the threaded fastener is adjustable to change a force required to pivot the handle and the pulley relative to the housing.

10. A snow thrower comprising:

a frame including an auger housing;

a plurality of wheels coupled to the frame;

a prime mover supported by the frame;

an auger positioned within the auger housing and coupled to the prime mover to be driven by the prime mover;

a chute rotatably mounted to the frame to direct material away from the frame; and a chute rotation mechanism supported by the frame and operable to rotate the chute relative to the frame, the chute rotation mechanism including a ring gear fixed to the chute, a drive gear engaging the ring gear, a handle assembly pivotable relative to the frame, a first cable extending between the drive gear and the handle assembly, wherein the handle assembly is pivotable in a first direction to tension the first cable and rotate the drive gear, thereby rotating the ring gear and the chute in a corresponding first direction, and a second cable extending between the drive gear and the handle assembly, wherein the handle assembly is pivotable in a second direction to tension the second cable and rotate the drive gear, thereby rotating the ring gear and the chute in a corresponding second direction, wherein the chute and the ring gear rotate about a chute rotation axis, and wherein the drive gear rotates about a drive axis that is generally perpendicular to the chute rotation axis.

11. The snow thrower of claim 10, wherein the ring gear has a first diameter and the drive gear has a second diameter, and wherein a ratio of the second diameter to the first diameter is less than 1.0.

12. The snow thrower of claim 11, wherein movement of the handle assembly through an arc of about 180 degrees rotates the ring gear and the chute about 220 degrees.

13. The snow thrower of claim 10, wherein the ring gear includes a first series of teeth and the drive gear includes a second series of teeth, and wherein the second series of teeth includes a relatively large tooth that is receivable in a relatively large recess between adjacent teeth of the first series of teeth.

14. The snow thrower of claim 10, wherein the chute rotation mechanism further includes a detent mechanism that releasably holds the chute in a plurality of discrete rotational positions, the detent mechanism including a pawl pivotally coupled to the frame, the pawl being engageable with the ring gear to hold the ring gear and the chute against rotation and being pivotable away from the ring gear to allow rotation of the ring gear and the chute, a bracket coupled to a portion of the frame, and a biasing member extending between the pawl and the bracket, the biasing member biasing the pawl into engagement with the chute.

15. The snow thrower of claim 14, wherein the frame defines a plurality of slots, and wherein the bracket is alternately receivable in each of the plurality of slots to adjust a biasing force of the biasing member on the pawl.

16. The snow thrower of claim 10, wherein the frame further includes an operator control assembly extending from the frame opposite the auger housing, wherein the handle assembly includes a housing mounted to the operator control assembly, a pulley positioned within the housing, and a handle coupled to the pulley and extending from the housing, and wherein the pulley and the handle are pivotable relative to the housing.

17. The snow thrower of claim 16, wherein the plurality of wheels is coupled to the frame to rotate about a first axis, and wherein the pulley and the handle are pivotable about a second axis that is generally parallel to the first axis.

18. The snow thrower of claim 17, wherein at least a portion of the handle extends outwardly from a side of the housing generally along the second axis.

19. The snow thrower of claim 16, wherein the handle is coupled to the pulley by a threaded fastener, and wherein the threaded fastener is adjustable to change a force required to pivot the handle and the pulley relative to the housing.

20. A chute rotation mechanism for a snow thrower, the snow thrower including a frame and a chute rotatably mounted to the frame, the chute rotation mechanism comprising:

a ring gear configured to be mounted to the chute;

a drive gear engaging the ring gear;

a handle assembly configured to pivot relative to the frame;

a first cable extending between the drive gear and the handle assembly, wherein the handle assembly is pivotable in a first direction to tension the first cable and rotate the drive gear, thereby rotating the ring gear in a corresponding first direction;

a second cable extending between the drive gear and the handle assembly, wherein the handle assembly is pivotable in a second direction to tension the second cable and rotate the drive gear, thereby rotating the ring gear in a corresponding second direction, wherein the ring gear includes a first series of teeth and the drive gear includes a second series of teeth, and wherein the second series of teeth includes a relatively large tooth that is receivable in a relatively large recess between adjacent teeth of the first series of teeth.

21. A snow thrower comprising:

a frame including an auger housing;

a plurality of wheels coupled to the frame;

a prime mover supported by the frame;

an auger positioned within the auger housing and coupled to the prime mover to be driven by the prime mover;

a chute rotatably mounted to the frame to direct material away from the frame; and a chute rotation mechanism supported by the frame and operable to rotate the chute relative to the frame, the chute rotation mechanism including a ring gear fixed to the chute, a drive gear engaging the ring gear, a handle assembly pivotable relative to the frame, a first cable extending between the drive gear and the handle assembly, wherein the handle assembly is pivotable in a first direction to tension the first cable and rotate the drive gear, thereby rotating the ring gear and the chute in a corresponding first direction, and a second cable extending between the drive gear and the handle assembly, wherein the handle assembly is pivotable in a second direction to tension the second cable and rotate the drive gear, thereby rotating the ring gear and the chute in a corresponding second direction, wherein the ring gear includes a first series of teeth and the drive gear includes a second series of teeth, and wherein the second series of teeth includes a relatively large tooth that is receivable in a relatively large recess between adjacent teeth of the first series of teeth.

22. A snow thrower comprising:

a frame including an auger housing;

a plurality of wheels coupled to the frame;

a prime mover supported by the frame;

an auger positioned within the auger housing and coupled to the prime mover to be driven by the prime mover;

a chute rotatably mounted to the frame to direct material away from the frame; and a chute rotation mechanism supported by the frame and operable to rotate the chute relative to the frame, the chute rotation mechanism including a ring gear fixed to the chute, a drive gear engaging the ring gear, a handle assembly pivotable relative to the frame, a first cable extending between the drive gear and the handle assembly, wherein the handle assembly is pivotable in a first direction to tension the first cable and rotate the drive gear, thereby rotating the ring gear and the chute in a corresponding first direction, and a second cable extending between the drive gear and the handle assembly, wherein the handle assembly is pivotable in a second direction to tension the second cable and rotate the drive gear, thereby rotating the ring gear and the chute in a corresponding second direction, wherein the chute rotation mechanism further includes a detent mechanism that releasably holds the chute in a plurality of discrete rotational positions, the detent mechanism including a pawl pivotally coupled to the frame, the pawl being engageable with the ring gear to hold the ring gear and the chute against rotation and being pivotable away from the ring gear to allow rotation of the ring gear and the chute, a bracket coupled to a portion of the frame, and a biasing member extending between the pawl and the bracket, the biasing member biasing the pawl into engagement with the chute, wherein the frame defines a plurality of slots, and wherein the bracket is alternately receivable in each of the plurality of slots to adjust a biasing force of the biasing member on the pawl.

23. A snow thrower comprising:

a frame including an auger housing;

a plurality of wheels coupled to the frame;

a prime mover supported by the frame;

an auger positioned within the auger housing and coupled to the prime mover to be driven by the prime mover;

a chute rotatably mounted to the frame to direct material away from the frame; and a chute rotation mechanism supported by the frame and operable to rotate the chute relative to the frame, the chute rotation mechanism including a ring gear fixed to the chute, a drive gear engaging the ring gear, a handle assembly pivotable relative to the frame, a first cable extending between the drive gear and the handle assembly, wherein the handle assembly is pivotable in a first direction to tension the first cable and rotate the drive gear, thereby rotating the ring gear and the chute in a corresponding first direction, and a second cable extending between the drive gear and the handle assembly, wherein the handle assembly is pivotable in a second direction to tension the second cable and rotate the drive gear, thereby rotating the ring gear and the chute in a corresponding second direction, wherein the frame further includes an operator control assembly extending from the frame opposite the auger housing, wherein the handle assembly includes a housing mounted to the operator control assembly, a pulley positioned within the housing, and a handle coupled to the pulley and extending from the housing, and wherein the pulley and the handle are pivotable relative to the housing, and wherein the plurality of wheels is coupled to the frame to rotate about a first axis, and wherein the pulley and the handle are pivotable about a second axis that is generally parallel to the first axis.

* * * * *